US008038450B2

(12) United States Patent
Nakagawa

(10) Patent No.: US 8,038,450 B2
(45) Date of Patent: Oct. 18, 2011

(54) COAXIAL CONNECTOR AND METHOD OF ASSEMBLING THE SAME

(75) Inventor: Tsuyoshi Nakagawa, Tokyo (JP)

(73) Assignee: Hirose Electric Co., Ltd, Tokyo (JP)

( * ) Notice: Subject to any disclaimer, the term of this patent is extended or adjusted under 35 U.S.C. 154(b) by 1 day.

(21) Appl. No.: 12/731,239

(22) Filed: Mar. 25, 2010

(65) Prior Publication Data

US 2010/0248539 A1 Sep. 30, 2010

(30) Foreign Application Priority Data

Mar. 31, 2009 (JP) ..... 2009-084990

(51) Int. Cl.
*H01R 12/00* (2006.01)

(52) U.S. Cl. ..... 439/63; 439/188; 439/578

(58) Field of Classification Search ..... 439/63, 439/188, 578, 733.1
See application file for complete search history.

(56) References Cited

U.S. PATENT DOCUMENTS 7,794,253 B2 * 9/2010 Wang et al. ..... 439/188
7,891,979 B2 * 2/2011 Chien et al. ..... 439/63
7,927,108 B2 * 4/2011 Gong et al. ..... 439/63

FOREIGN PATENT DOCUMENTS

JP 2007-141665 6/2007

* cited by examiner

*Primary Examiner* — Khiem Nguyen
(74) *Attorney, Agent, or Firm* — Kubotera & Associates, LLC

(57) ABSTRACT

A coaxial connector for connecting a coaxial plug includes an insulation housing including an insertion opening portion and a pressing deformation portion situated above the insertion opening portion; an outer conductive member including a pressing portion for pressing the pressing deformation portion; a stationary terminal including a contact portion; and a movable terminal fitted into the insertion opening portion and including a fixed portion and an elastic portion. The elastic portion is separated from the contact portion so that the movable terminal is electrically disconnected from the stationary terminal when the coaxial plug is inserted into the insulation housing. The elastic portion contacts with the central conductive member so that the movable terminal is electrically connected to the central conductive member when the coaxial plug is inserted into the insulation housing.

7 Claims, 9 Drawing Sheets

COAXIAL CONNECTOR AND METHOD OF ASSEMBLING THE SAME

BACKGROUND TECHNOLOGY AND RELATED TECHNOLOGY

The present invention relates to a coaxial connector to be mounted on a board. More specifically, the present invention relates to a coaxial connector having a switch, which has a switching mechanism to switch high-frequency signal circuits.

A conventional coaxial connector having a switch has been widely used for inspecting built-in high-frequency circuits in a portable communication device such as a cell phone and the like.

The conventional coaxial connector having the switch includes, for example, an insulation housing, which has a vertical hole that can receive a central conductive member of a coaxial plug therein, and an outer conductor provided outside the insulation housing. The conventional coaxial connector further includes a stationary terminal and a movable terminal, which are provided below the vertical hole. The stationary terminal has a contact portion, and the movable terminal has a fixed portion to be secured on the insulation housing and an elastic portion that can abut against the central conductive member of the coaxial plug and can contact with the contact portion (for example, see Patent Reference).

Patent Reference: Japanese Patent Publication No. 2007-141665

In the conventional coaxial connector having the switch, when the coaxial plug is not attached thereto, the movable terminal is pushed against the contact portion of the stationary terminal by an elastic force of the elastic portion, so that the stationary terminal is electrically connected to the movable terminal. On the other hand, when the coaxial plug is attached to the conventional coaxial connector, a lower end portion of the central conductive member of the coaxial plug is inserted in the vertical hole of the connector. In this state, the central conductive member abuts against the elastic portion. Accordingly, the elastic portion is pushed down by the central conductive member, so as to be elastically deformed and moved away from the contact portion. As a result, the stationary terminal is electrically disconnected from the movable terminal. At the same time, the central conductive member is electrically connected to the movable terminal. When the coaxial plug is attached to the conventional coaxial connector, a signal, which is flowing from the movable terminal to the stationary terminal, flows from the movable terminal to the central conductive member. Accordingly, it is possible to inspect a high-frequency circuit that is connected to the movable terminal.

In the conventional coaxial connector described above, even after the movable terminal and stationary terminal are assembled into the insulation housing, an insertion hole, through which the movable terminal, especially the elastic portion thereof, is inserted into the insulation housing, remains an opened state. Accordingly, a foreign substance may enter the conventional coaxial connector through the insertion hole, so that the foreign substance causes an adverse effect on connection between the stationary terminal and the movable terminal.

Patent Reference has disclosed a technique to solve such a problem. According to Patent Reference, the conventional coaxial connector has an extending section disposed on a side of the insulation housing where the movable terminal is inserted in. After the movable terminal is inserted in the insulation housing through the insertion hole, a pressing section provided on the outer conductor is bent downwardly to bend downwardly the extending section of the insulation housing, so that the insertion hole is closed.

According to the technique disclosed in Patent Reference, it is necessary to provide an additional step of bending the pressing section and the extending section to close the insertion hole. Further, it is difficult to reduce an outer dimension of the conventional coaxial connector due to the pressing section and the extending section.

In view of the problems described above, an object of the invention is to provide a coaxial connector having a closing structure capable of preventing a foreign substance from entering without an additional step such as a bending process and the like.

Further objects and advantages of the invention will be apparent from the following description of the invention.

SUMMARY OF THE INVENTION

In order to attain the objects described above, according to a first aspect of the present invention, a coaxial connector with a switch to be mounted on a circuit board includes an insulation housing, which has a hole that can accept therein a central conductive member of a coaxial plug from above, an outer conductor, which is provided outside the insulation housing and in which an outer conductor of the coaxial plug can be attached/detached, and a stationary terminal and a movable terminal, which are provided below the hole and can contact/move away from each other.

In the first aspect of the present invention, the insulation housing has an insertion hole to press the movable terminal therein and a press deformation section, which is provided on an upper portion of the insertion hole. The press deformation section is pressed down by the pressing section upon attachment of the outer conductor top the insulation housing and thereby closes the insertion hole. The stationary terminal has a contact portion and the movable terminal has a fixed portion to be secured onto the insulation housing and an elastic portion, which extends like a cantilever from the fixed portion, capable of abutting against the central conductive member of the coaxial plug and contact with the contact portion.

In the first aspect of the present invention, when the central conductive member of the coaxial plug is not fitted into the hole of the insulation housing, the elastic portion contacts with the contact portion, and thereby the stationary terminal and the movable terminal are electrically connected. When the central conductive member of the coaxial plug are fitted in the hole of the insulation housing, the central conductive member abuts to the elastic portion so as to move the elastic portion away from the contact portion and thereby the stationary terminal and the movable terminal are electrically disconnected. Accordingly, the central conductive member of the coaxial plug and the movable terminal are electrically connected.

According to a second aspect of the present invention, a method of assembling a coaxial connector with a switch to be mounted on a circuit board includes: a first step of pressing the movable terminal into space inside the insulation housing through a first insertion hole; a second step of pressing the stationary terminal in the space inside the insulation housing through a second insertion hole of the insulation housing; and a third step of covering the insulation housing with the outer conductor from above and then bending a side face of the outer conductor so as to swage. In the third step, the press deformation section provided on an upper portion of the first insertion hole of the insulation housing is pressed down by the pressing section of the outer conductor so as to bend the press deformation section downward, and thereby the first insertion hole is closed.

According to the invention, it is possible to easily prevent foreign substances from entering the coaxial connector with the simple structure.

DETAILED DESCRIPTION OF THE PREFERRED EMBODIMENTS

Figure 1:
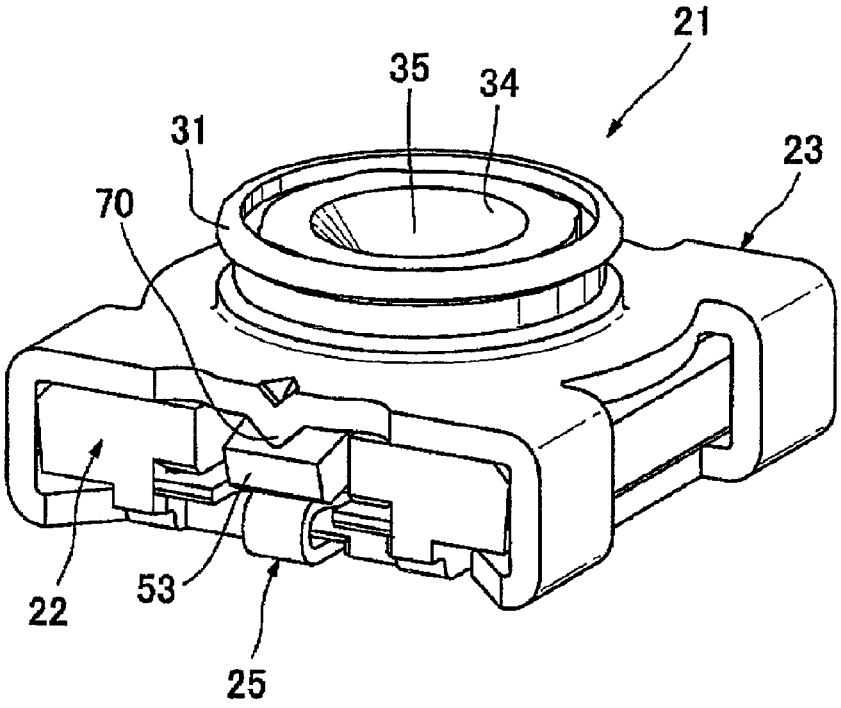
FIG. 1 is a perspective view showing a whole structure of a coaxial connector having a switch according to a first embodiment of the invention.

Hereunder, embodiments of the invention will be fully described based on the accompanying drawings. Here, in the drawings showing the embodiments of the invention, basically, the same reference numerals are used for the same members and repetitive explanation is omitted.

First Embodiment

Figure 2:
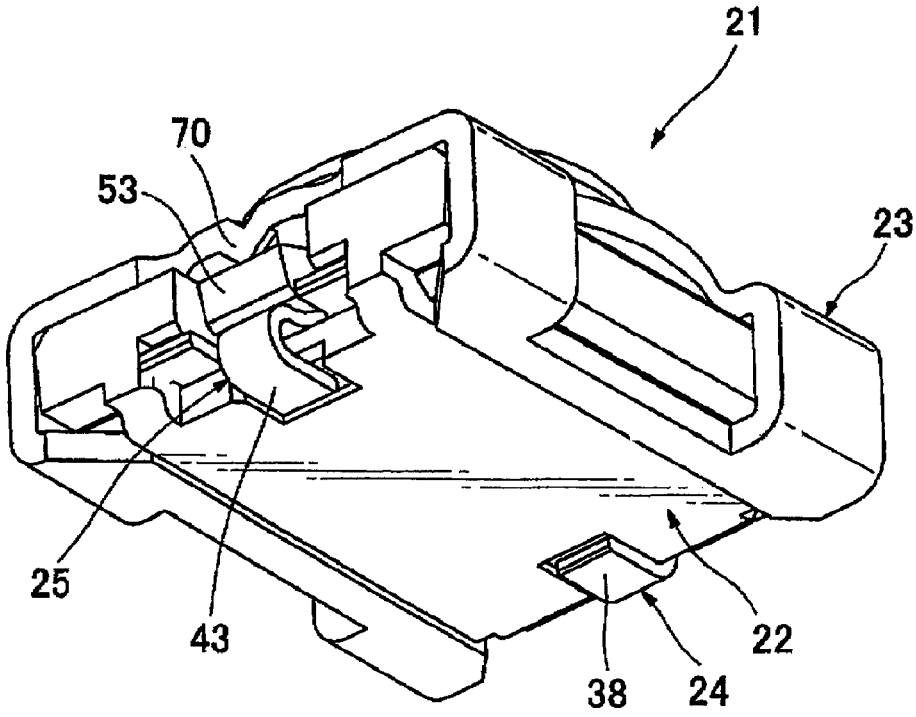
FIG. 2 is a perspective view showing the whole structure of the coaxial connector having the switch according to the first embodiment of the invention.
Figure 3:
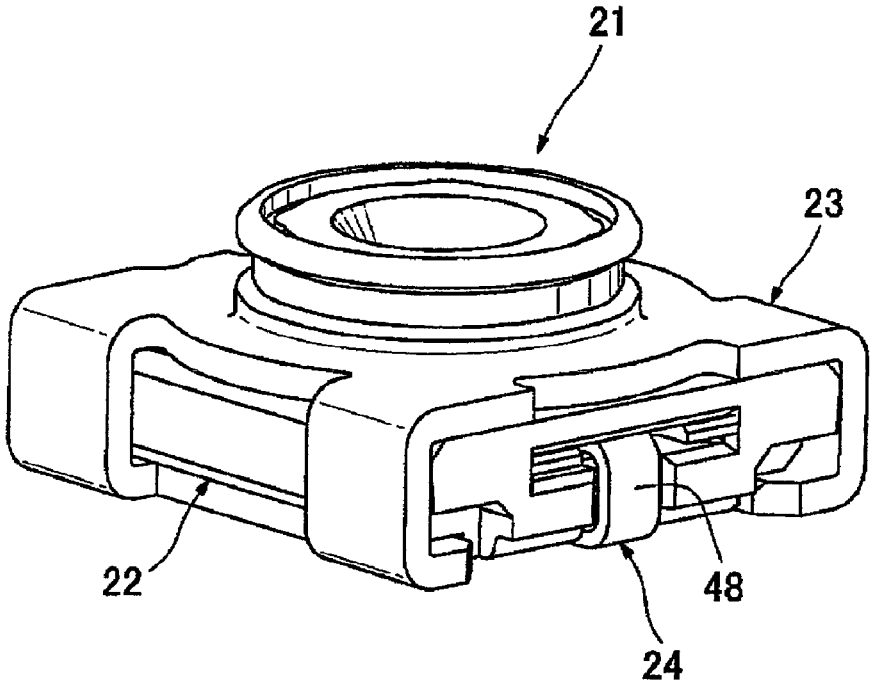
FIG. 3 is a perspective view showing the whole structure of the coaxial connector having the switch according to the first embodiment of the invention.
Figure 4:
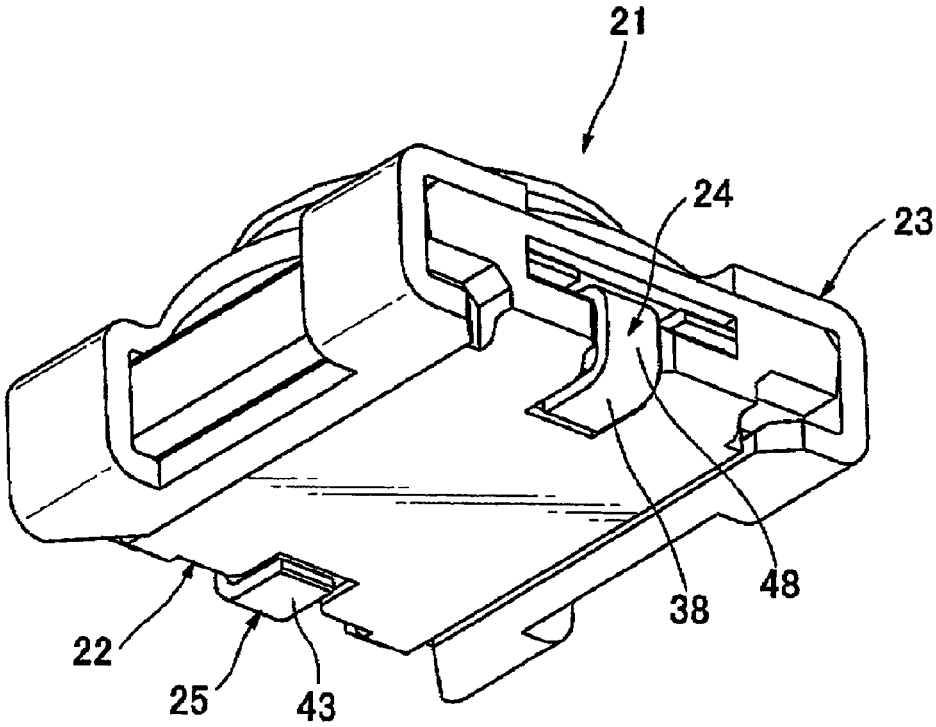
FIG. 4 is a perspective view showing the whole structure of the coaxial connector having the switch according to the first embodiment of the invention.
Figure 5:
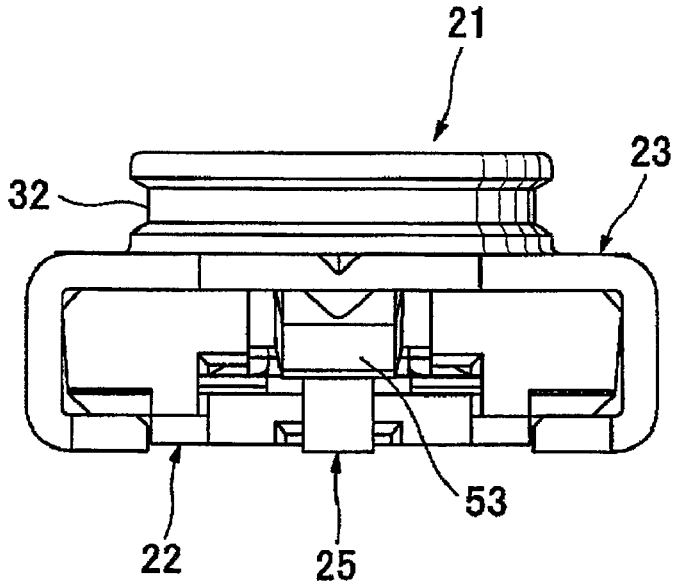
FIG. 5 is a left side view showing the whole structure of the coaxial connector having the switch according to the first embodiment of the invention.
Figure 6:
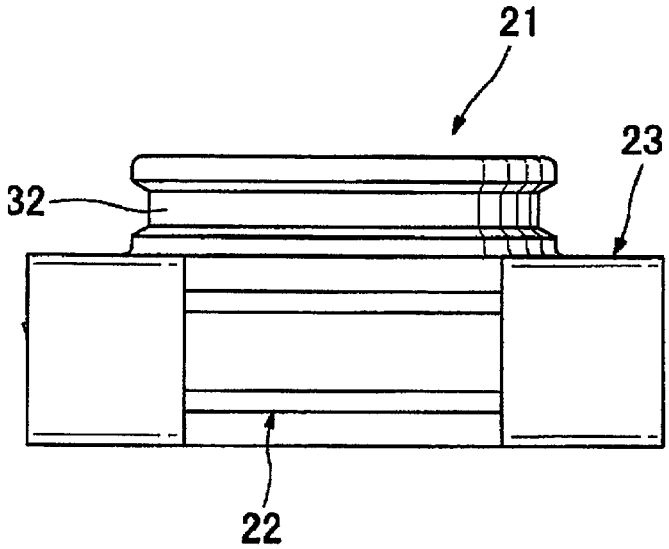
FIG. 6 is a front view showing the whole structure of the coaxial connector having the switch according to the first embodiment of the invention.
Figure 7:
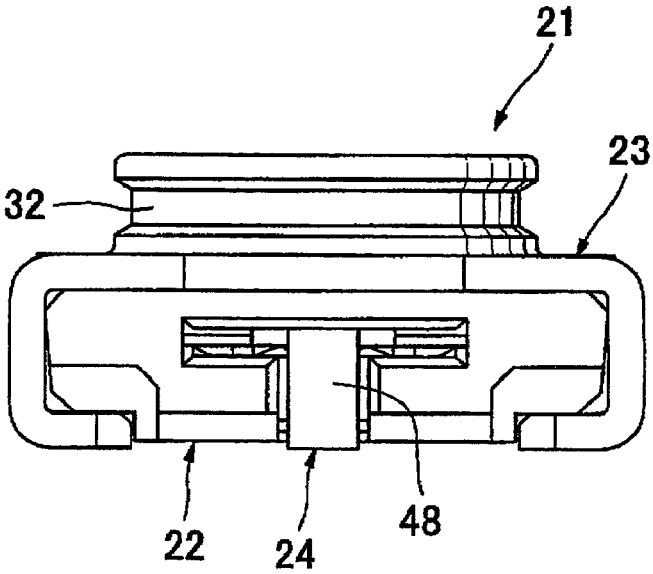
FIG. 7 is a right side view showing the whole structure of the coaxial connector having the switch according to the first embodiment of the invention.
Figure 8:
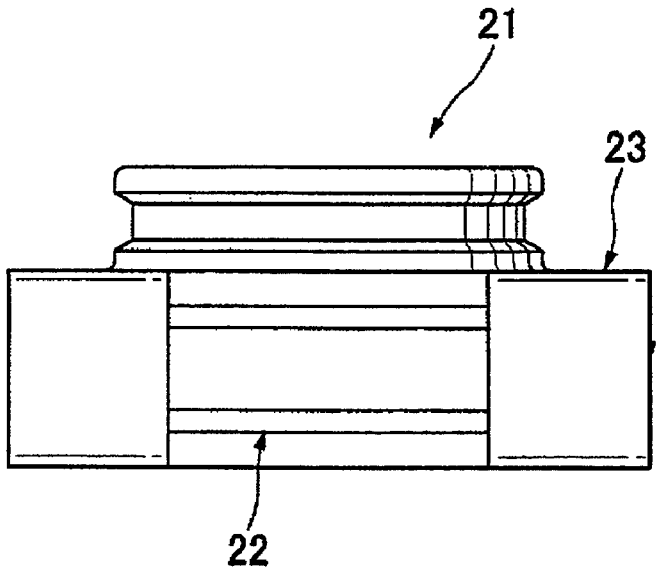
FIG. 8 is a backside view showing the whole structure of the coaxial connector having the switch according to the first embodiment of the invention.
Figure 9:
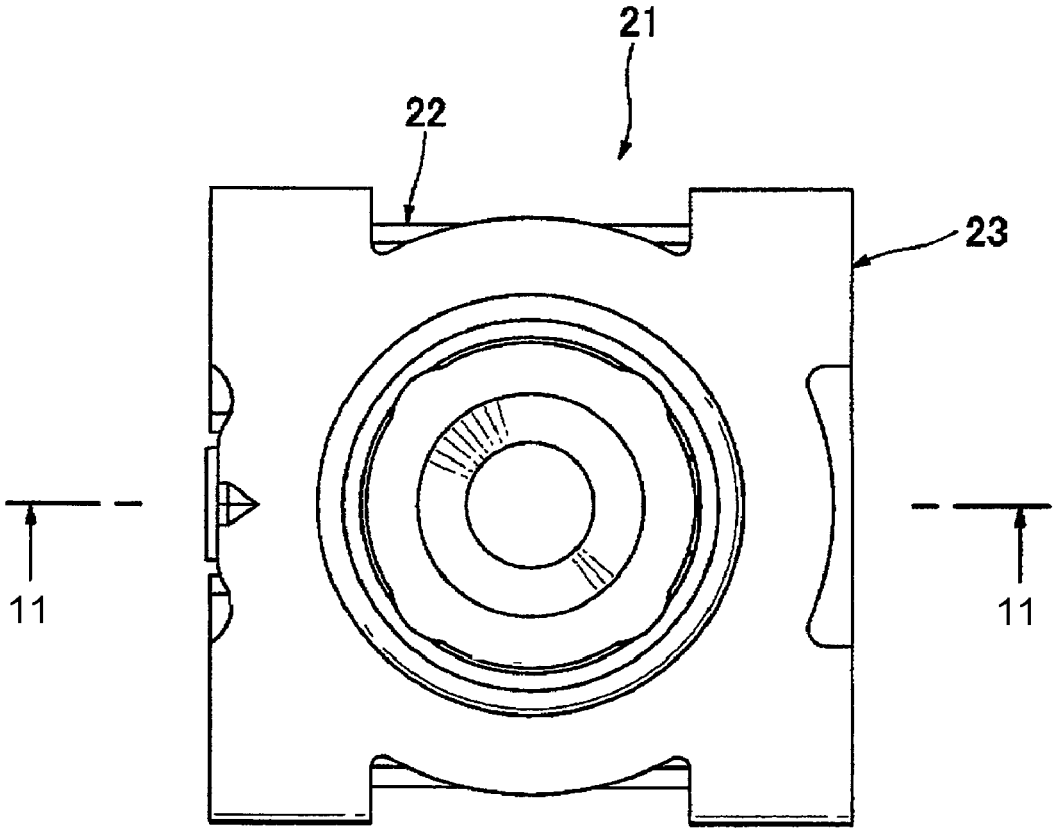
FIG. 9 is a top view showing the whole structure of the coaxial connector having the switch according to the first embodiment of the invention.
Figure 10:
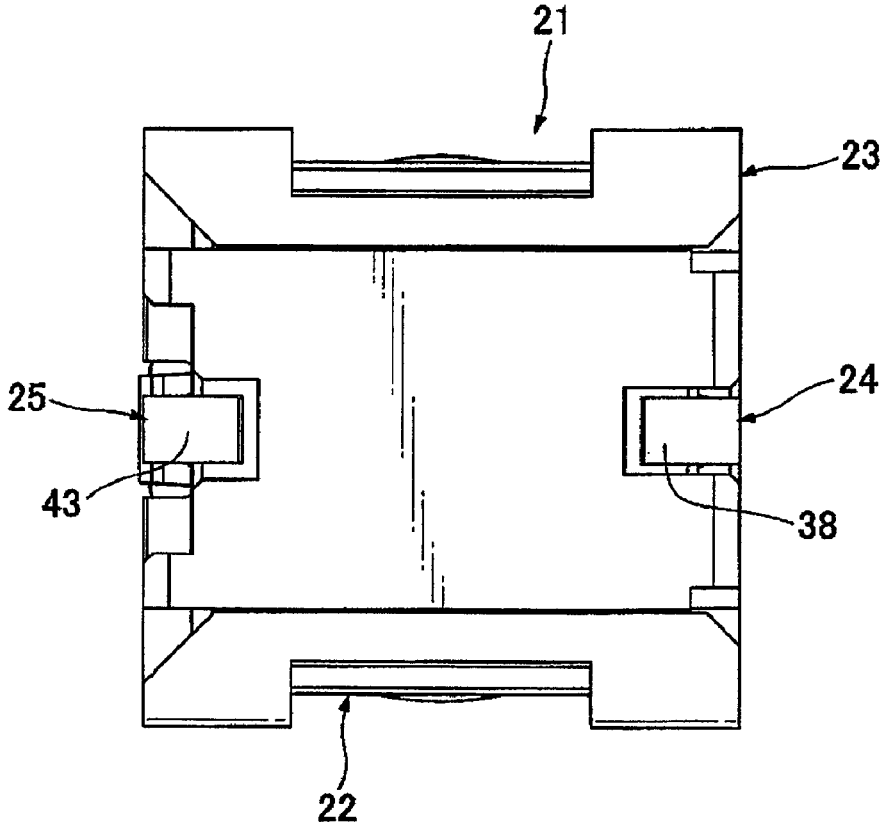
FIG. 10 is a bottom-side view showing the whole structure of the coaxial connector having the switch according to the first embodiment of the invention.

FIGS. 1-10 show the whole view of a coaxial connector 21 having a switch according to a first embodiment of the invention. More specifically, FIGS. 1 through 4 are perspective views of the coaxial connector 21 according to the first embodiment. In particular, FIG. 1 is the view from the upper left side, FIG. 2 is the view from the lower left side, FIG. 3 is a view from the upper right side, and FIG. 4 is a view from the lower right side.

Figure 11:
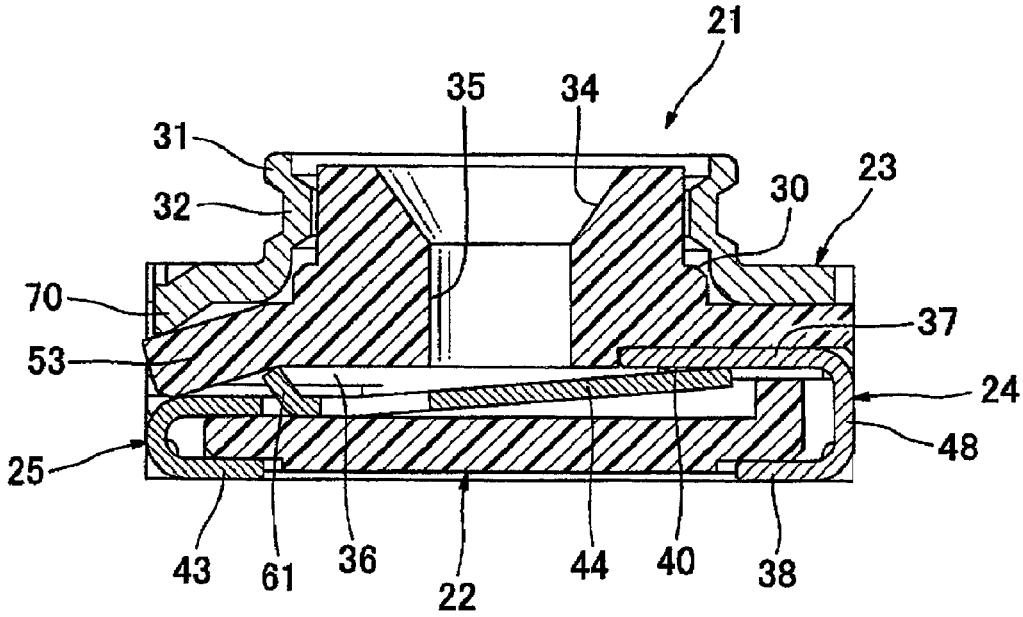
FIG. 11 is a sectional view of the coaxial connector having the switch taken along a line 11-11 in FIG. 9 according to the first embodiment of the invention.
Figure 12:
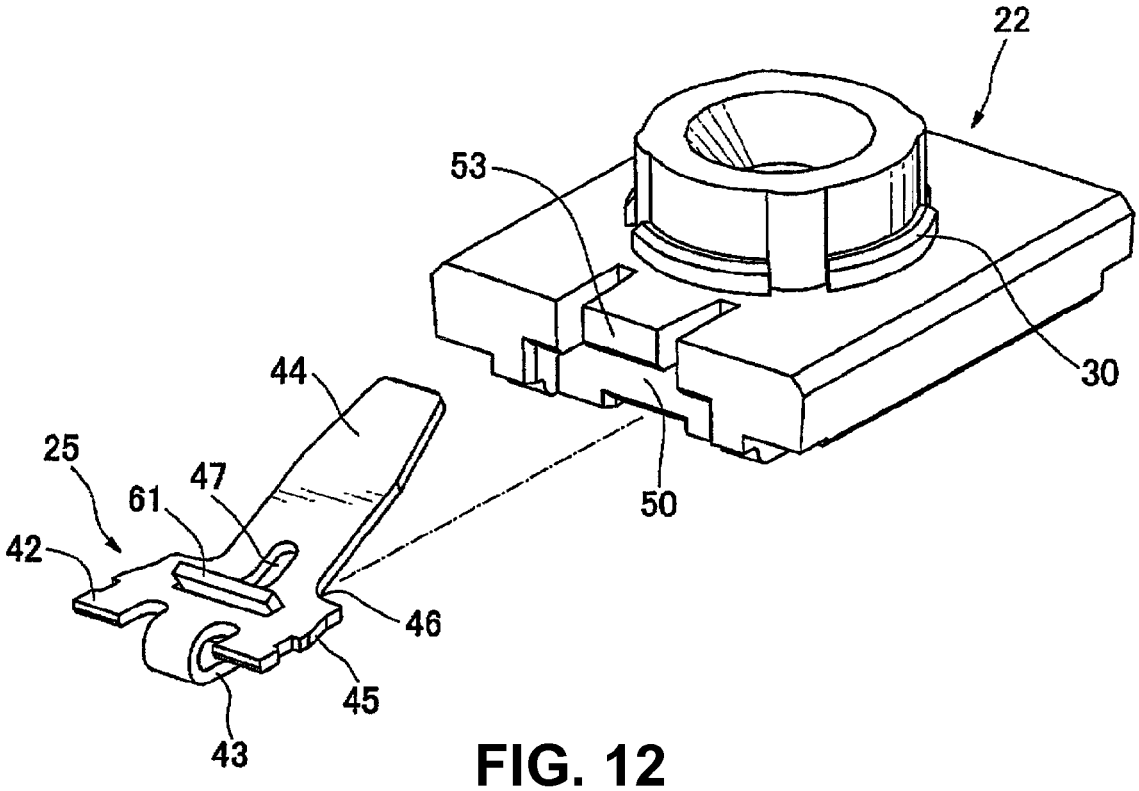
FIG. 12 is a perspective view of the coaxial connector having the switch in a state before integrating a movable terminal into an insulation housing according to the first embodiment of the invention.
Figure 13:
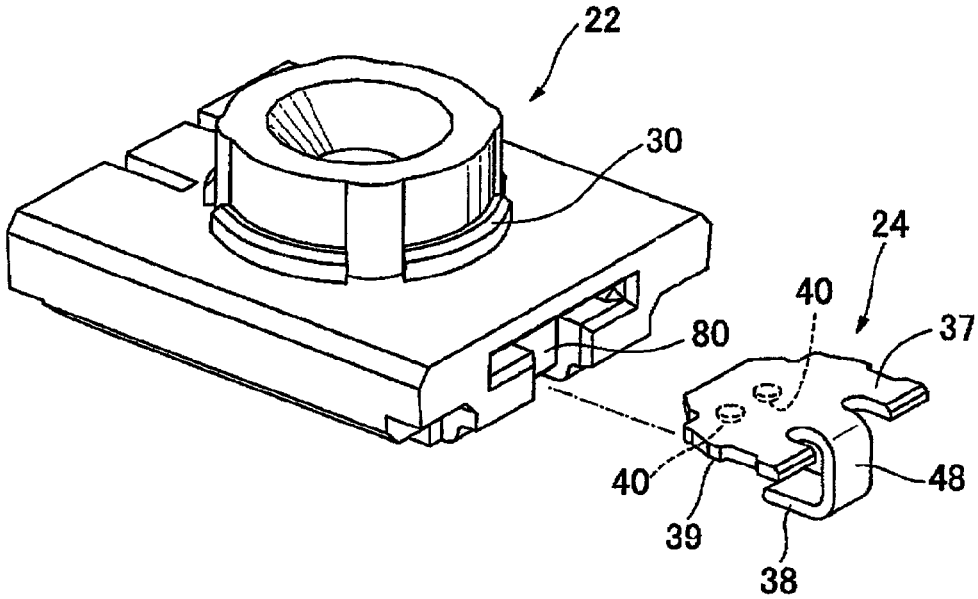
FIG. 13 is a perspective view of the coaxial connector having the switch in a state before integrating a stationary terminal into the insulation housing according to the first embodiment of the invention.
Figure 14:
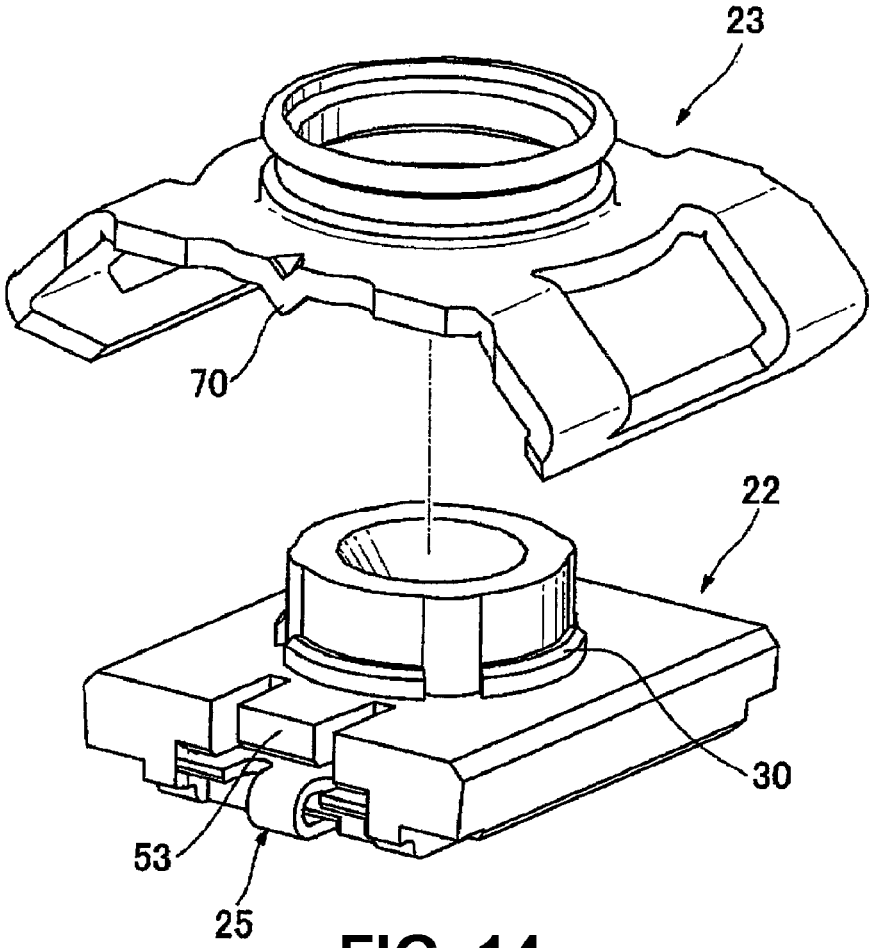
FIG. 14 is a perspective view of the coaxial connector having the switch in a state before attaching an outer conductor to the insulation housing according to the first embodiment of the invention.

FIGS. 5 through 10 are a left-side view, front view, right-side view, backside view, top view and a bottom-side view of the coaxial connector 21 of the first embodiment. FIG. 11 is a sectional view taken along a center line (sectional view taken along line 11-11 of FIG. 9) of the coaxial connector 21 according to the first embodiment. FIG. 12 shows a state before integrating a movable terminal 25 into an insulation housing 22; FIG. 13 shows a state before integrating a stationary terminal 24 into the insulation housing 22; and FIG. 14 shows a state before integrating an outer conductor 23 into the insulation housing 22.

As shown in FIGS. 1 through 10, according to the first embodiment, the coaxial connector 21 having a switch mainly includes the insulation housing 22 that is a generally rectangular solid and is made of resin such as plastic, a metal outer conductor 23 provided outside the insulation housing 22, and a stationary terminal 24 and a movable terminal 25, at least a part of each being provided inside the insulation housing 22.

The coaxial connector 21 can be mounted on a circuit board (not illustrated), and can form a part of a board circuit being connected to the circuit board via a board connection section 38 (well illustrated in FIGS. 2 and 4) of the stationary terminal 24 exposed outside and a board connection section 43 of the movable terminal 25.

A step-like section 30 is annularly formed under an outer circumferential portion, which is generally cylindrical, on an upper portion of the insulation housing 22. There is an annular groove 32 having a semicircular section on the outer circumferential face of an upper portion 31 of the outer conductor 23. The annular groove 32 having a semicircular cross-section is formed on an outer circumferential surface of the upper portion 31 of the outer conductor 23, and a lower end (not illustrated) of the outer conductor on the coaxial plug side can be fitted to the annular groove 32.

In addition, a conical depression 34 is formed on an upper face of the insulation housing 22, and a vertical hole 35 that can accept a central conductive member of the coaxial plug from above is formed at a center part of the bottom surface of the depression 34. Furthermore, under the vertical hole 35, there is a laterally long space 36 that connects to the vertical hole 35. When a coaxial plug (not illustrated) is attached to the coaxial connector 21, a lower end of the central conductive member (not illustrated) is inserted in the vertical hole 35 and reaches the space 36.

As well illustrated, the movable terminal 25 has a flat fixed portion 42, a board connecting section 43, which is formed by being bent downward into U-shape from the base end side of the fixed portion 42, and an elastic portion 44 that extends like a cantilever diagonally upward toward the tip from the fixed portion 42. The elastic portion 44 can abut to the central conductive member of the coaxial plug, and can contact with a lower end of the contact portion 40 of the stationary terminal 24, which will be described later, at the front end side than the abutting position.

A wedge-like protrusion 45 is formed on the side section of the fixed portion 42 and the fixed portion 42 is horizontally pressed in space 36 through an insertion hole 50 of the insulation housing 22 from the opposite side to the press-in direction of the stationary terminal 24 via the protrusion 45. The insertion hole 50 is a generally protruded opening so as to allow insertion of the elastic portion 44. The both outer circumferential sections of the elastic portion 44 are broadened from a position near the abutting position towards the fixed portion 42 of the movable terminal 25, and have a shape that is curved to depress.

Further, the elastic portion 44 has a notched section 47 on the fixed portion 42 side from the abutting position, and the notched section 47 extends along the elastic portion 44. Moreover, the fixed portion 42 has a vertical piece 61, and this vertical piece 61 is formed to have a sharp angle towards the opening of the inside (space 36) of the insertion hole 50. These configurations enable prevention of intrusion of foreign substances from the insertion hole 50.

Especially when the insertion hole 50 is left open, a contact point between the contact portion 40 and the elastic portion 44 can be directly seen from the insertion hole 50. Therefore, the above effects can be achieved by deforming the press deformation section 53 so as to make the contact point not directly seen.

As well shown in FIG. 13, the stationary terminal 24 has a flat fixed portion 37, a board connecting section 38, which is provided at an edge portion being bent downward to a square-bottomed shape from the basal end of the fixed portion 37, and an arm 48 between the fixed portion 37 and the board connecting section 38. Here, the fixed portion 37 is designed to have much larger width in the horizontal direction than width of the arm 48.

The fixed portion 37 has wedge-like protrusions 39 formed on the side portion, and through those protrusions 39, the fixed portion 37 is horizontally pressed in the space 36 through an insertion hole 80 of the insulation housing 22 from the side of the insulation housing 22. As a result, the fixed portion 37 is placed in the insulation housing 22 and sections other than that, the arm 48 and the board connecting section 38, are left exposed to outside the insulation housing 22. Further, the fixed portion 37 has a contact portion 40, which protrudes downward, at a generally center portion thereof (see FIG. 11), so as to increase the contact pressure with the elastic portion 44 and thereby enhance the reliability of the contact. Here, the insertion hole 80 is an opening having a horizontally long rectangular shape.

As well shown in FIGS. 1, 2, 12, and 14, the insulation housing 22 has a press deformation section 53 having elasticity on an upper part of the insertion hole 50 on the side of pressing the movable terminal 25. The press deformation section 53 is formed by providing cuts (or slits) on an upper portion of the insertion hole 50 of the insulation housing 22.

In addition, as well shown in FIG. 14, the outer conductor 23 has a pressing section 70, which protrudes from a portion that faces the press deformation section 53. Upon attaching the outer conductor 23 onto the insulation housing 22, the pressing section 70 presses down and thereby deforms the press deformation section 53, so as to close the space under the press deformation section 53 of the insertion hole 50. In other words, the press deformation section 53 can work as a covering section to close the insertion hole 50.

As well shown in FIGS. 3 through 7 and 13, the insulation housing 22 has an insertion hole 80, which has a shape corresponding to the cross-section of the fixed portion 37 in the press-in direction, on the side of pressing the fixed portion 37 of the stationary terminal 24.

The coaxial connector 21 having a switch according the first embodiment may be used for inspecting a high-frequency circuit to be built in a portable communication device such as a cellular phone machine. In addition, the outer conductor 23 is shielded for a high-frequency circuit and impedance is matched between the movable terminal 25 and the stationary terminal 24.

When the coaxial plug (not illustrated) is not attached, the movable terminal 25 is pressed onto the contact portion 40 of the stationary terminal 24 by elastic force of the elastic portion 44, and the stationary terminal 24 and the movable terminal 25 keep their electrically connected states. When the coaxial plug is attached, a lower end portion of an outer conductor (not illustrated) of the coaxial plug abuts to the outer conductor 23 and the lower end portion of the central conductive member (not illustrated) of the coaxial plug is inserted into the vertical hole 35.

In this state, the central conductive member of the coaxial plug abuts the elastic portion 44. At this time, since the elastic force of the central conductive member of the coaxial plug is stronger than that of the elastic portion 44, the elastic portion 44 is pressed down by the central conductive member of the coaxial plug to elastically deform and moves away from the contact portion 40, and thereby the stationary terminal 24 and the movable terminal 25 are electrically disconnected. At the same time, the central conductive member of the coaxial plug and the movable terminal 25 are in their electrically connected state.

With this operation, signals that flow from the movable terminal 25 to the stationary terminal 24 can flow from the movable terminal 25 to the central conductive member of the coaxial plug and thereby it is possible to inspect a high-frequency circuit.

Referring now to FIGS. 12 through 14, a method of assembling the coaxial connector having a switch 21 according to the first embodiment will be described.

As shown in FIG. 12, the movable terminal 25 is pressed in the space 36 of the insulation housing 22 through the insertion hole 50 of the insulation housing 22.

Then, as shown in FIG. 13, the stationary terminal 24 is pressed in the space 36 of the insulation housing 22 through the insertion hole 80 of the insulation housing 22. At this time, the stationary terminal 24 is pressed therein from above the vertical hole 35 of the insulation housing 22 while pressing down the elastic portion 44 with a jig so as not to rub the contact portion 40 and the elastic portion 44 against each other.

Thereafter as shown in FIG. 14, the outer conductor 23 is attached outside the insulation housing 22. At this time, the outer conductor 23 is applied over the insulation housing 22 from above and then swaged by bending the side faces of the outer conductor 23. With this procedure, the outer conductor 23 is secured onto the insulation housing 22. At this time, since the pressing section 70 of the outer conductor 23 contacts with and then presses down the press deformation section 53 of the insulation housing 22, the press deformation section 53 is pressed down and the space of the insertion hole 50 is closed.

Accordingly, according to the coaxial connector having a switch 21 of the first embodiment, since the insertion hole 50 is closed and the closed section is formed at the same time as attaching the outer conductor 23 to the insulation housing 22, it does not require an additional step, such as the step of bending a pressing section or extending section as in the technique described in Patent Reference 1, and it is also possible to reduce intrusion of foreign substances into the product.

Moreover, since it does not require a pressing section or an extending section, it is also possible to reduce the outer dimension of the product. Further, since the fixed portion 42 of the movable terminal 25 has a vertical section 61, intrusion of foreign substances inside the space of the space 36 from the insertion hole 50 can be even more securely prevented.

Second Embodiment

A second embodiment of the present invention will be explained next. FIGS. 15 through 18 show the whole view of the coaxial connector having a switch 21*a* according to a second embodiment.

Figure 15:
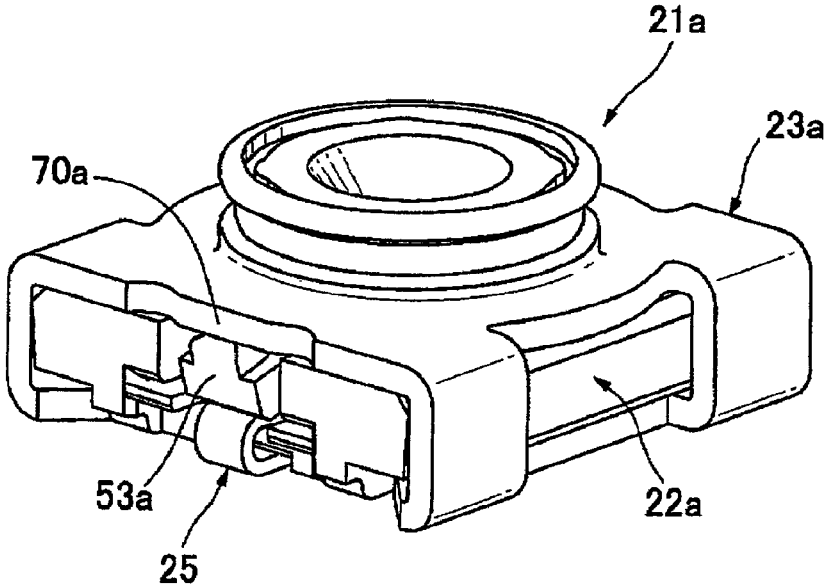
FIG. 15 is a perspective view showing a whole structure of a coaxial connector having a switch according to a second embodiment of the invention.
Figure 16:
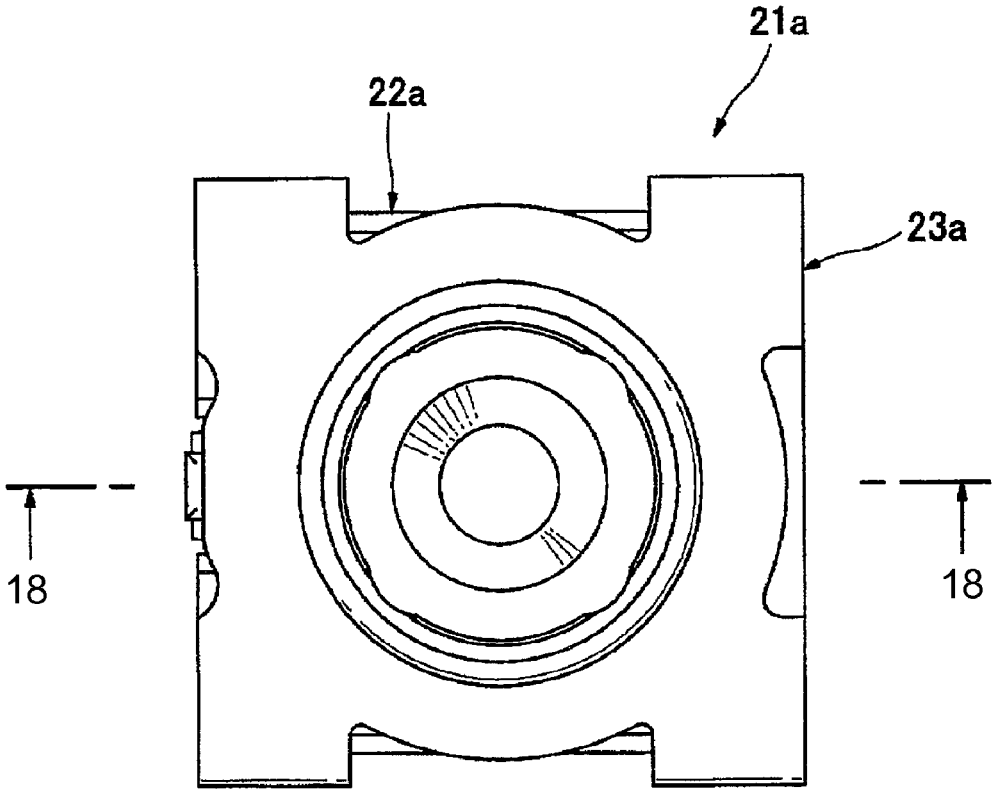
FIG. 16 is a top view showing the whole structure of the coaxial connector having the switch according to the second embodiment of the invention.
Figure 17:
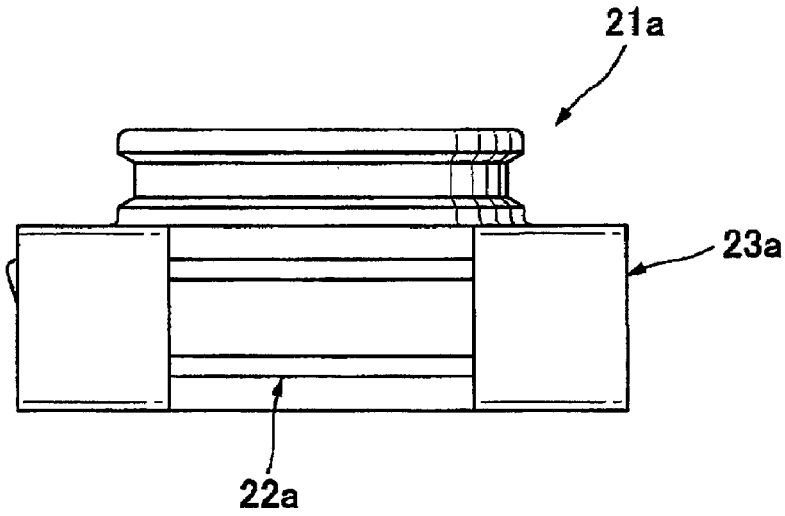
FIG. 17 is a front view showing the whole structure of the coaxial connector having the switch according to the second embodiment of the invention.
Figure 18:
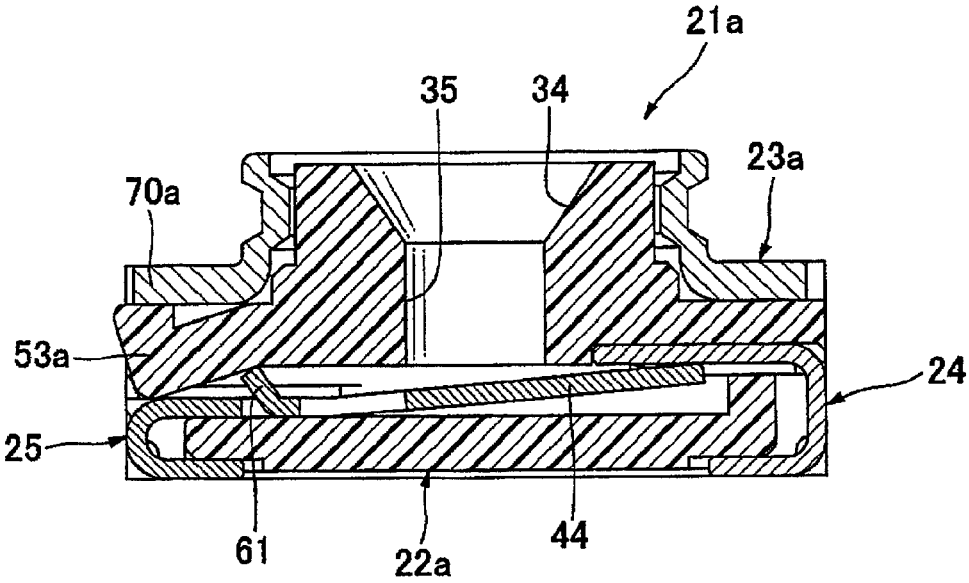
FIG. 18 is a sectional view of the coaxial connector having the switch taken along a line 18-18 in FIG. 16 according to the second embodiment of the invention.
Figure 19:
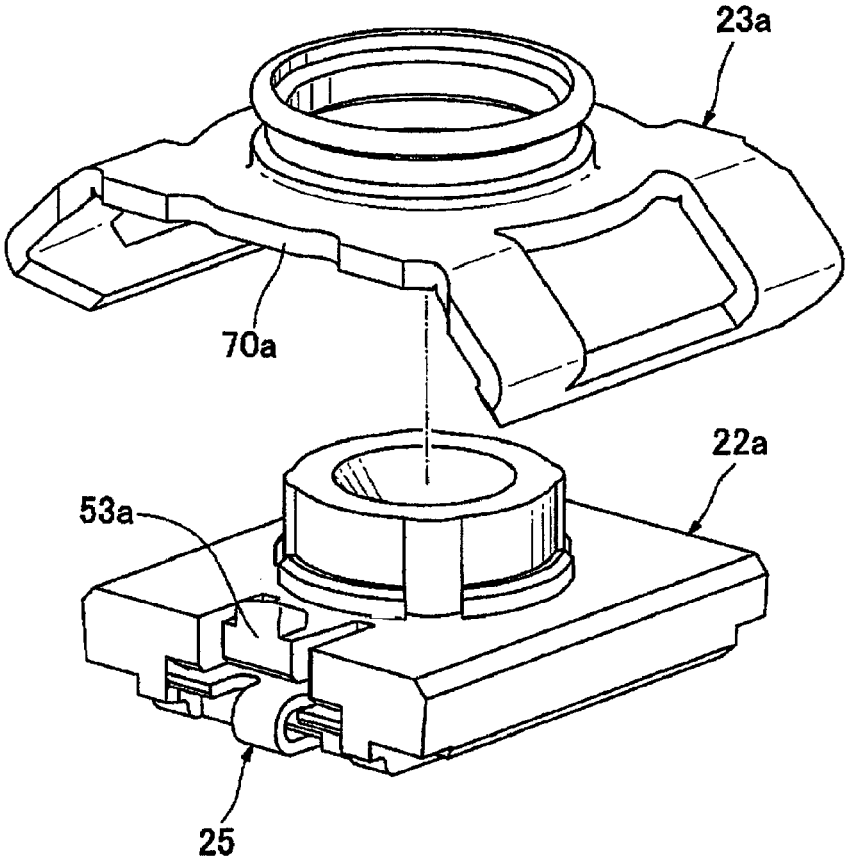
FIG. 19 is a perspective view of the coaxial connector having the switch in a state before attaching an outer conductor to an insulation housing according to the second embodiment of the invention.

More specifically, FIG. 15 is a perspective view of the coaxial connector 21*a*, which is viewed from the upper left side. FIGS. 16 and 17 are a top view and a front view of the coaxial connector 21*a* of the second embodiment. FIG. 18 is a sectional view taken along line a centerline of the coaxial connector 21*a* of the second embodiment (sectional view taken along A-A of FIG. 16). FIG. 19 shows a state of the coaxial connector before integrating the outer conductor 23*a* into the insulation housing 22*a*.

While a portion of the pressing section 70 of the outer conductor 23, which faces the insulation housing 22, protrudes in the coaxial connector 21 of the first embodiment, the pressing section 70*a* of the outer conductor 23*a* is flat and a portion of the press deformation section 53*a* of the insulation housing 22*a*, which faces the outer conductor 23*a*, protrudes in the coaxial connector 21*a* of the second embodiment. Upon attaching the outer conductor 23*a* to the insulation housing 22*a*, the protrusion of the press deformation section 53*a* of the insulation housing 22*a* is pressed down by the pressing section 70*a* to deform the press deformation section 53*a*, and thereby the insertion hole 50 is closed. In other words, the press deformation section 53*a* can work as a closing section to close the insertion hole 50.

Here, since other portions of the coaxial connector 21*a* of the second embodiment are similar to those in the coaxial connector 21 of the first embodiment, explanation is omitted.

Therefore, according to the coaxial connector having a switch 21*a* of the second embodiment, it is possible to achieve similar effects to those in the coaxial connector having a switch of the first embodiment.

In the above description, aspects of the invention are described in detail based on the embodiments, but it should be noted that the invention shall not be limited to those embodiments and may be varied, altered, or modified within the scope of the invention.

For example, in the above-described embodiments, a coaxial connector having a switch for a high-frequency circuit is described, but the application is not limited to this and the invention may be applied to even other general connectors. Especially, the invention can significantly achieve the effects in connectors in which intrusion of foreign substance is a critical matter.

The disclosure of Japanese Patent Application No. 2009-084990, filed on Mar. 31, 2009 is incorporated in the application by reference.

While the invention has been explained with reference to the specific embodiments of the invention, the explanation is illustrative and the invention is limited only by the appended claims.

What is claimed is:

1. A coaxial connector for connecting a coaxial plug having a central conductive member, comprising:

an insulation housing including an insertion opening portion and a pressing deformation portion situated above the insertion opening portion;

an outer conductive member disposed on an outer surface of the insulation housing, said outer conductive member including a pressing portion for pressing the pressing deformation portion when the outer conductive member is attached to the insulation housing so that the pressing deformation portion deforms to cover the insertion opening portion;

a stationary terminal including a contact portion; and a movable terminal fitted into the insertion opening portion, said movable terminal including a fixed portion fixed to the insulation housing and an elastic portion for contacting with the contact portion so that the movable terminal is electrically connected to the stationary terminal when the coaxial plug is not inserted into the insulation housing, said elastic portion being arranged to be separated from the contact portion so that the movable terminal is electrically disconnected from the stationary terminal when the coaxial plug is inserted into the insulation housing, said elastic portion being arranged to contact with the central conductive member so that the movable terminal is electrically connected to the central conductive member when the coaxial plug is inserted into the insulation housing.

2. The coaxial connector according to claim 1, wherein said elastic portion extends from the fixed portion in a beam shape.

3. The coaxial connector according to claim 1, wherein said stationary terminal and said movable terminal are disposed below an opening portion of the insulation housing for receiving the coaxial plug so that the stationary terminal and the movable terminal are separable from each other.

4. The coaxial connector according to claim 1, wherein said pressing portion includes a protruding portion facing the pressing deformation portion.

5. The coaxial connector according to claim 1, wherein said pressing deformation portion includes a protruding portion facing the pressing portion.

6. The coaxial connector according to claim 1, wherein said pressing deformation portion is formed of a cut portion formed in the insulation housing above the insertion opening portion.

7. The coaxial connector according to claim 1, wherein said movable terminal further includes a rising piece for blocking the insertion opening portion.

* * * * *